US008287388B2

(12) United States Patent
Meyer et al.

(10) Patent No.: US 8,287,388 B2
(45) Date of Patent: Oct. 16, 2012

(54) UNIVERSAL LOGIC ENCLOSURE FOR ELECTRONIC GAMING DEVICE

(75) Inventors: John-Martin Meyer, Henderson, NV (US); John Palchetti, Las Vegas, NV (US)

(73) Assignee: Perpetual Gaming, Inc., Henderson, NV (US)

( * ) Notice: Subject to any disclaimer, the term of this patent is extended or adjusted under 35 U.S.C. 154(b) by 73 days.

(21) Appl. No.: 13/026,772

(22) Filed: Feb. 14, 2011

(65) Prior Publication Data

US 2011/0201431 A1 Aug. 18, 2011

Related U.S. Application Data

(60) Provisional application No. 61/304,841, filed on Feb. 16, 2010.

(51) Int. Cl.
*A63F 9/24* (2006.01)

(52) U.S. Cl. ..... 463/46; 463/20

(58) Field of Classification Search ..... 463/46
See application file for complete search history.

(56) References Cited

U.S. PATENT DOCUMENTS

2005/0215325 A1 9/2005 Nguyen et al.
2007/0054742 A1 3/2007 McComb et al.
2008/0182642 A1 7/2008 Cole

*Primary Examiner* — Omkar Deodhar
(74) *Attorney, Agent, or Firm* — Dickinson Wright PLLC

(57) ABSTRACT

A universal logic enclosure (16) to be inserted as a retro-fit solution into the cabinet (12) of an electronic gaming device (10) for the purpose of securely housing software and firmware components. The logic enclosure (16) includes a box-like central support frame (18) having side walls (32, 43, 38) each formed with a window (42) having substantially identical dimensional attributes to receive interchangeable cover plates (44). A logic door (50) can be affixed so as to hinge from any one of the walls (32, 34, 38, 48) by way of an integral hinge feature (52) that interacts with flanges (54) extending inwardly from the walls. The logic door (50) includes a key operated closure mechanism (58).

13 Claims, 7 Drawing Sheets

UNIVERSAL LOGIC ENCLOSURE FOR ELECTRONIC GAMING DEVICE

CROSS REFERENCE TO RELATED APPLICATIONS

This application claims priority to U.S. Provisional Patent Application No. 61/304,841 filed Feb. 16, 2010, the entire disclosure of which is hereby incorporated by reference and relied upon.

BACKGROUND OF THE INVENTION

1. Field of the Invention

A logic enclosure for an electronic gaming device.

2. Related Art

In the Electronic Gaming Device (EGD) manufacturing field, the part in which the brains of the EGD reside is referred to as the logic board or mother board. The logic board is then encased in a secure housing known as a logic enclosure or just the "enclosure." The dimensional attributes and configuration of the logic enclosure are specific to each manufacturer's cabinet, which is the term for the metal or wood shell of an EGD. Each manufacturer typically has multiple types of cabinets, each with their own particular logic enclosure design. In most cases, even within a given EGD manufacturer, one can not move the logic enclosure from one cabinet model to a different cabinet model. To keep a unique appearance, or to accommodate the available space located within each cabinet style, the logic enclosure design from one EGD manufacturer will be different from those of its competitors. There does not exist any published standard in logic enclosure designs. This lack of standardization has created a barrier from reusing, or transplanting, a logic enclosure from one manufacture's cabinet style, to another, as well as a barrier to a robust aftermarket for games that can be played on older machines.

US Patent Publication No. 2008/0182642 to Cole, published Jul. 31, 2008, discloses a universal presentation platform for electronic gaming machines configured to accept a variety of gaming devices. The entire disclosure of US 2008/0182642 is hereby incorporated by reference and relied upon. The presentation platform comprises a cabinet, a universal gaming device interface and standardized components. In one embodiment, the cabinet is modular and is assembled from base, side, top, back and door components or sections. The gaming device is stand-alone, and is capable of use in different gaming machines and is independently verifiable. The universal presentation platform described in the Cole publication has many deficiencies and shortcomings which make the system generally cumbersome, expensive and less well-suited for use in live gaming environments like casinos.

There is therefore a need for an improved universal logic enclosure for electronic gaming machines configured to accept a variety of gaming devices.

SUMMARY OF THE INVENTION

A universal, convertible electronic enclosure for an electronic gaming device includes a central support frame having a bottom. The bottom defines a periphery having first, second, third and fourth edges. First, second, third and fourth walls extend upwardly from the bottom to form enclosing sides. The first wall adjoins the bottom at the first edge and the second wall adjoins the bottom at its second edge. A first-second corner is created at the intersection of the first and second walls. The third wall adjoins the bottom at its third edge, and creates a second-third corner where it adjoins the second wall. The first, second and third walls each have a window opening. The windows have generally the same dimensional attributes in each of the first, second and third walls. A cover plate is removably disposed in each window. At least one of the cover plates is selected from the group consisting essentially of a vent plate, a vent/wire pass-through plate, and a power supply support plate. A floor portion is provided. The floor portion is dimensioned so as to slide into the central support frame between the first and third walls and overlay the bottom thereof. The fourth wall is dimensioned to slide into the central support frame and against the first and third walls proximate the fourth edge of the bottom of the central support frame. A logic door is provided having a generally square periphery and adapted in use to be secured relative to the first, second, third and fourth side walls, and spaced apart from the bottom of the central support frame to establish an enclosed space for housing the logic board and other control electronics. The logic door includes a hinge feature adapted to selectively engage any one of the first, second, third and fourth walls.

The subject invention is particularly adapted to overcome the shortcomings and deficiencies existing in prior art logic enclosure systems so as to make them more accessible and less expensive for use in live gaming environments and casinos. The subject logic enclosure is readily adaptable to many gaming systems, and is therefore more cost effective for refurbishing applications.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
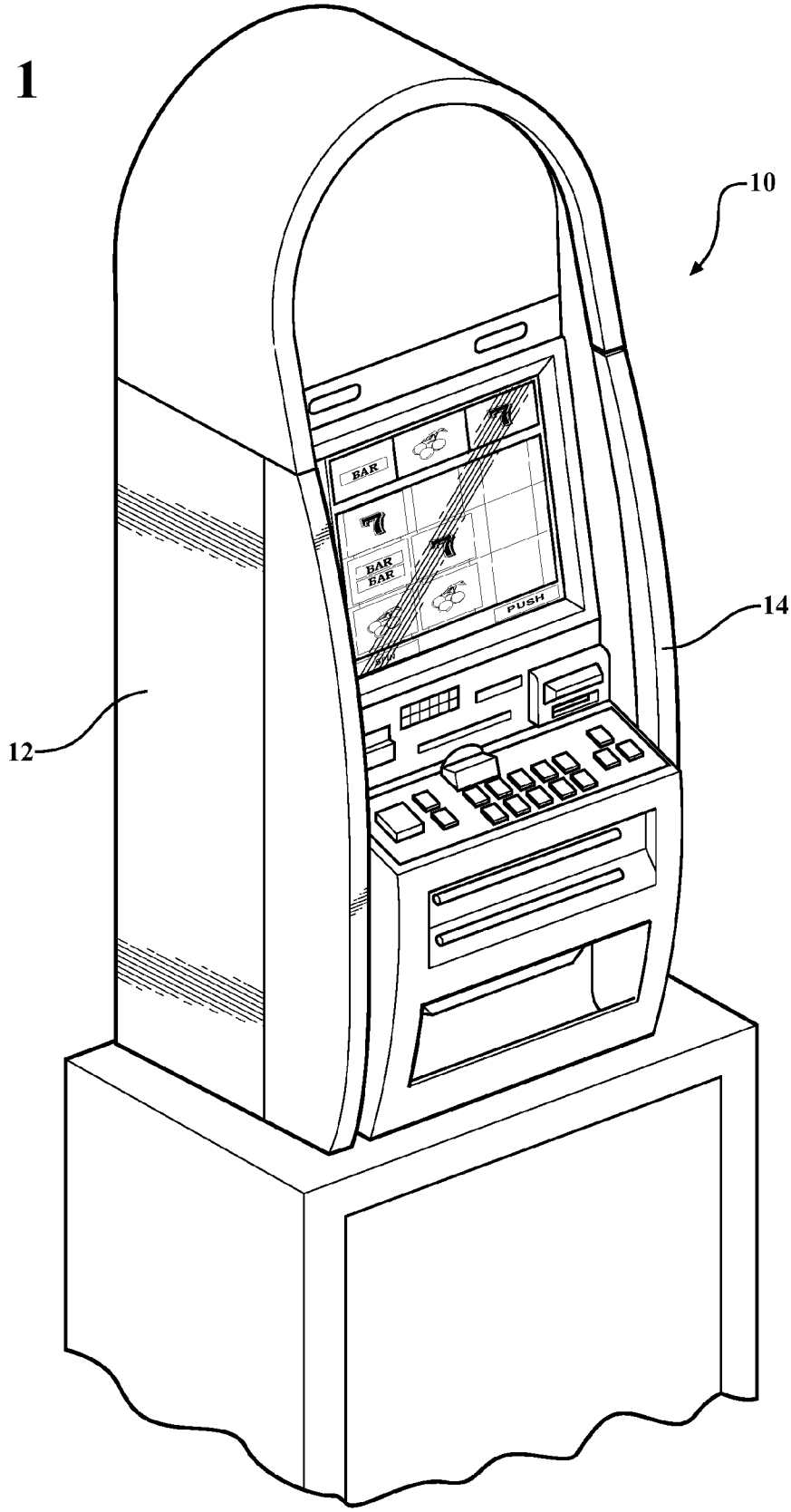
FIG. 1 is a perspective view of an exemplary electronic gaming machine.

Referring to the figures wherein like numerals indicate like or corresponding parts throughout the several views, an electronic gaming device is shown for illustrative purposes generally at 10 in FIG. 1. The gaming device 10 includes a cabinet 12 in which is contained all of the electrical components necessary to operate the game and associated peripheral devices. The cabinet 12 is typically made from wood and/or metal according to each manufacturer's specifications. The specific shape of the cabinet 12 will also vary substantially from one manufacturer to another. Access to the cabinet interior is provided by way of a front hinged door 14, as shown in FIG. 2, or by back panel access or other suitable method which may vary from one game manufacturer to the next.

Figure 2:
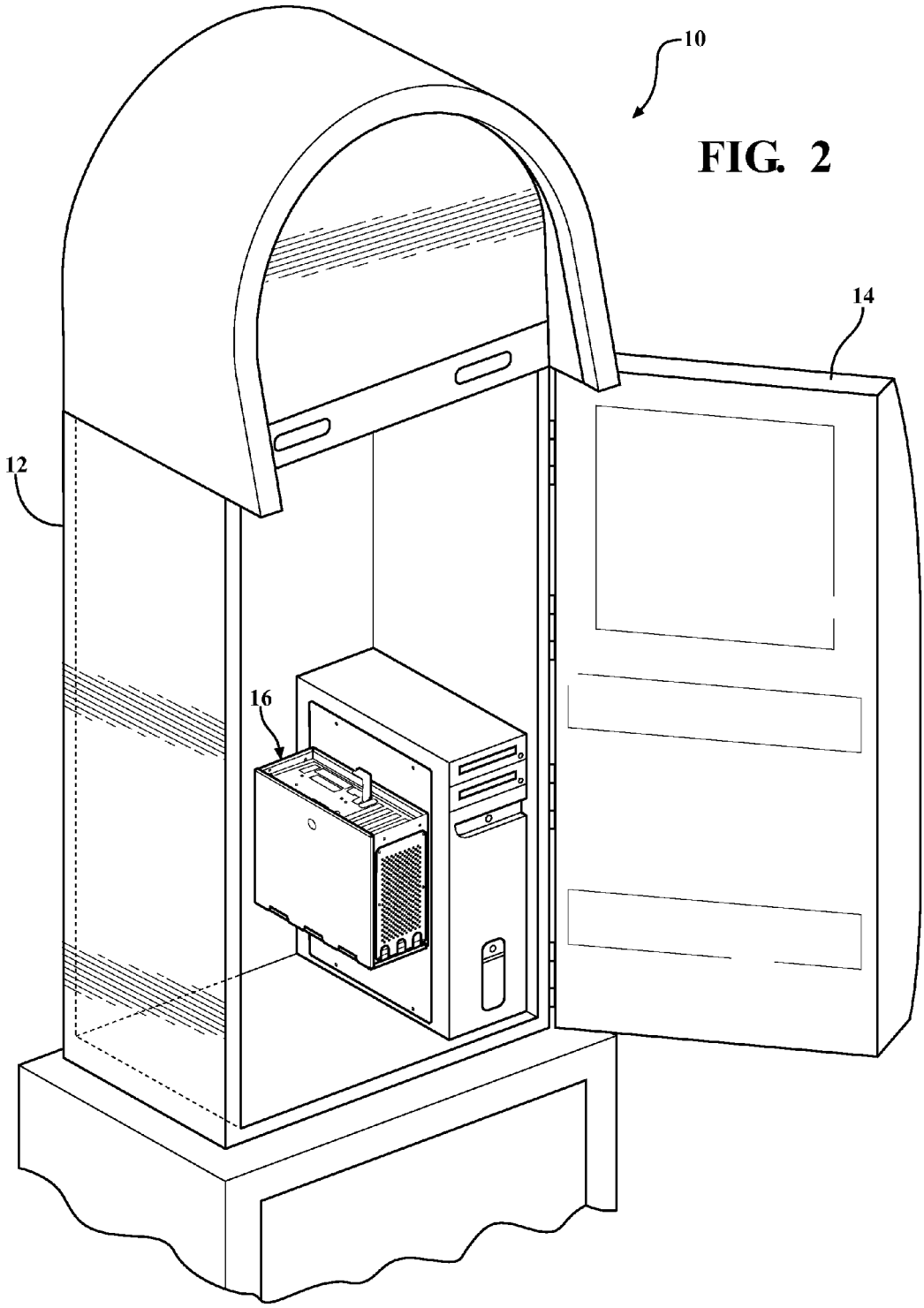
FIG. 2 is a perspective view of a gaming machine as in FIG. 1 showing its front door open to reveal a cavity inside within which a universal logic enclosure according to the subject invention may be stationed.
Figure 3:
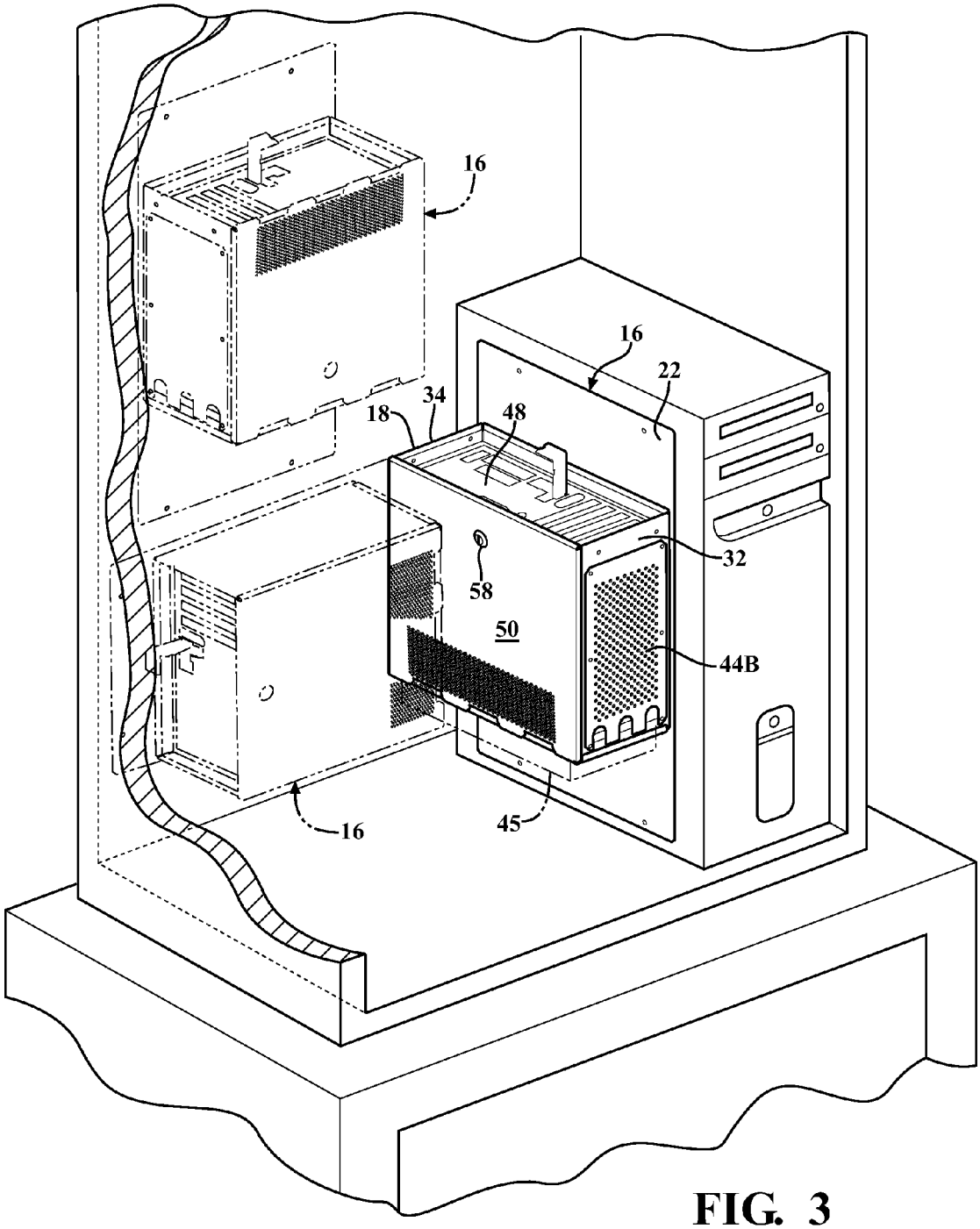
FIG. 3 is a close up view of the gaming machine cavity of FIG. 2 showing the subject logic enclosure unit mounted to the Bill Validator housing, together with various alternative mounting configurations and arrangements shown in phantom to highlight the adaptability of this invention.

A universal logic enclosure, generally indicated at 16 in FIG. 2, is adapted to be securely mounted inside the cabinet 12 of the gaming device 10. The particular location and orientation of the logic enclosure 16 will vary from one gaming cabinet design to the next depending on manufacturer, style, and other variables, as suggested by the alternatively placed logic enclosures shown in phantom in FIG. 3. Generally stated, the logic enclosure 16 is a system of components designed to be interchangeable between various cabinet 12 types and manufacturers. These components are designed to interact with the existing cabinet 12 game components and adapt them for connection and operation from the software and firmware housed within. With minimal effort, the subject logic enclosure 16 can be installed in new cabinets 12, or retrofitted into existing cabinets 12. Because of its ability to fit within most any commercial EGD, the logic enclosure 16 may be said to be manufacturer, as well as cabinet, "agnostic." Collectively, the logic enclosure 16 is comprised of three categories of components: a sturdy housing, the firmware components upon which the operating software runs, and wire harness adapters.

Figure 4:
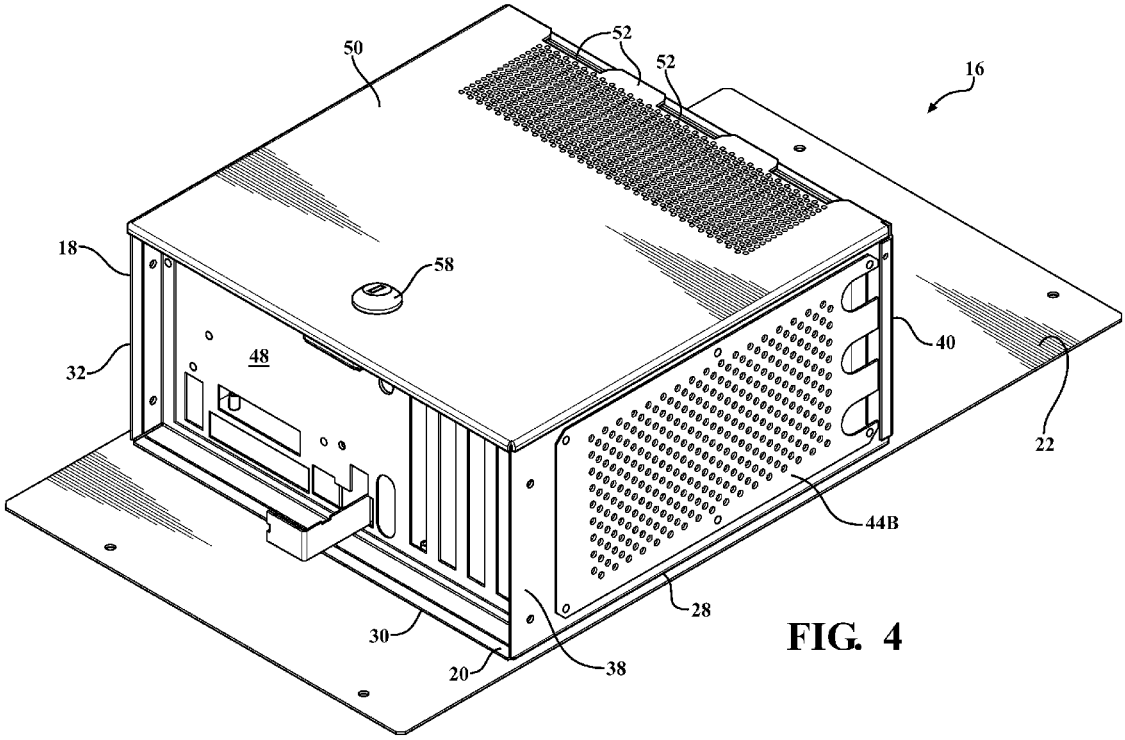
FIG. 4 is a perspective view of the universal convertible logic enclosure according to the subject invention.

The housing portion of the logic enclosure 16 is a modular system of panels and frames designed to be reconfigured to fit the needs of the cabinets 12 into which it will be installed and to accommodate the firmware being housed. The logic enclosure 16 is perhaps best shown in FIGS. 4-6 comprising a central support frame 18 having a bottom 20. The bottom 20 is adapted to be attached to a suitable surface within the gaming device cabinet 12 either directly, through a mounting bracket 22, or other suitable interface. As best shown in FIG. 6, the bottom 20 has a generally square periphery defined by first 24, second 26, third 28 and fourth 30 edges. A first wall 32 is joined to the bottom 20 at its first edge 24. Similarly, a second wall 34 adjoins the bottom 20 at the second edge 26 thereof. The second wall 34 attaches to the first wall 32 at a first-second corner 36. A third wall 38 adjoins the bottom 20 at its third edge 28, and extends upwardly therefrom to attach with the second wall 34 at a second-third corner 40.

The first 32, second 34 and third 38 walls each have a window 42 formed therein. The windows 42 each have generally the same dimensional attributes. In other words, the window 42 in each of the first 32, second 34 and third 38 walls is, preferably, the same size opening. A cover plate 44 is removably disposed in each of the windows 42 in the respective first 32, second 34 and third 38 walls. The cover plate 44 may take various forms including that of a vented cover plate 44A containing a plurality of small holes to allow circulation of air therethrough. The cover plate may also take the form of a vent/wire pass-through plate 44B including vent holes together with larger access openings for electrical wires (not shown). Alternatively still, the cover plate may take the form of a power supply support plate 44C. A power supply unit 45 is, for example, shown in FIG. 3 attached to the logic enclosure 16 via the cover plate 44C. Preferably at least one of the cover plates is selected from the above mentioned varieties 44A-C, however in the preferred embodiment all three cover plates 44A-C are used in the logic enclosure device 16, one each for the windows 42 in the walls 32, 34 and 38. The cover plates 44A-C are all of substantially identical dimensional size adapted to be seated selectively in any one of the windows 42. Accordingly, depending upon the particular application or installation for the logic enclosure 16, the cover plates 44A-C can be arranged to suit the immediate conditions.

More specifically, the cover plates 44 are fixed in position using suitable fastener devices which are universally interchangeable so that any one of the cover types (44A-C) can fit in any one of the windows 42. In the preferred embodiment, perhaps best shown in FIGS. 5 and 6, the universal fastener may comprise a pattern of holes in the respective walls 32, 34, 38 that surround the windows 42. Complimentary studs are formed in each cover plate 44 and arranged to pass through the pattern of holes around any of the windows, projecting into the inner cavity of the enclosure 16. The studs may be designed to accept threaded nuts, push nuts, clips, or any other type of retaining device to secure the cover plate 44 in position over a window 42.

A removable floor portion 46 is provided. The floor portion 46 is dimensioned to slide into the central support frame 18 between the first 32 and third 38 walls. The floor portion 46 overlies the bottom 20. A fourth wall 48 is provided. The fourth wall 48 is dimensioned to slide into the central support frame 18 against the first 32 and third 38 walls proximate the fourth edge 30 of the bottom 20. The walls 32, 34, 38, 48, together with the bottom 20 form a generally box-like structure. The walls 32, 34, 38 and 48 form a square when viewed from above.

In one embodiment of this invention, the floor portion 46 and the fourth wall 48 may be integrally formed as a unitary electronics mounting plate slidable into and out of the central support frame 18. As a result, electronics and other components to be housed within the logic enclosure 16 may be mounted to the combined floor portion 46 and fourth wall 48 so that they may be removed, as a unit, from the central support frame 18 during service operations. As shown, the floor portion 46 may join the fourth wall 48 at a generally perpendicular angle.

Figure 7:
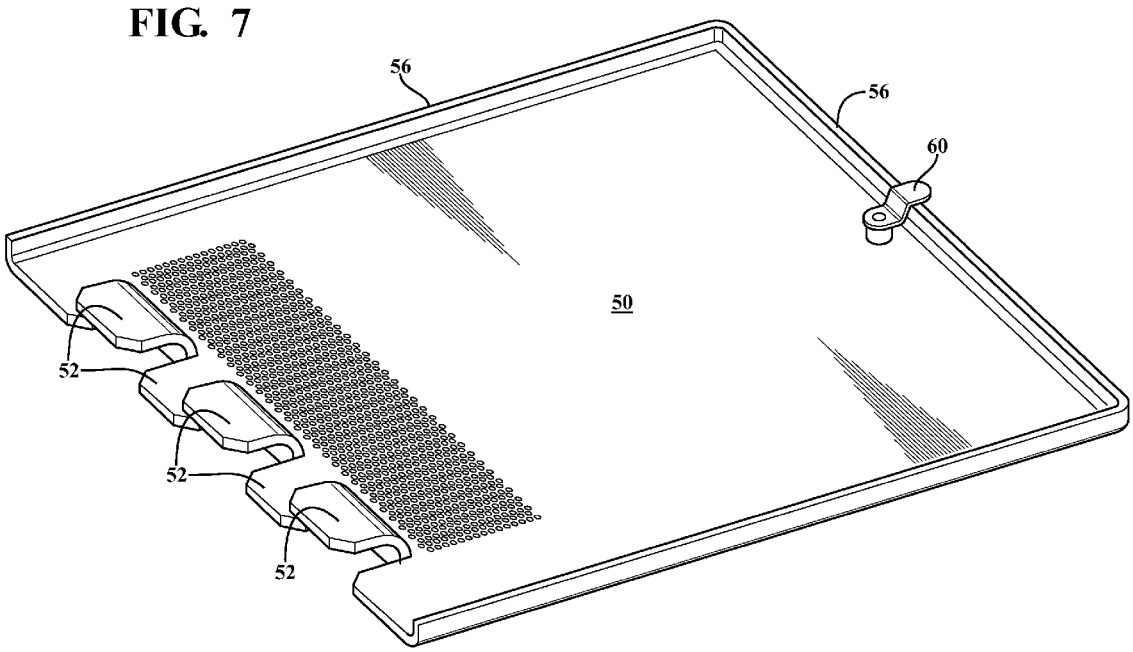
FIG. 7 is a perspective, upside down view of the cover plate component of the subject logic enclosure.

A logic door 50 has a generally square periphery and is adapted, in use, to be secured relative to the walls 32, 34, 38 and 48. When secured with the logic door 50 spaced apart from the bottom 20, an enclosed space is established for containing the game control electronics as described above. The logic door 50 includes a hinge feature 52 adapted to selectively engage any one of the first 32, second 34, third 38 and fourth 48 walls. In particular, each of the walls include an inwardly directed flange 54 running generally the entire length thereof. The hinge feature 52 of the logic door 50 is selectively engageable with any of the flanges 54 thereby providing combined retention and hinging capabilities in four alternative positions. As perhaps best shown in FIG. 7, the hinge feature 52 may comprise a series of integrally formed and alternately offset tabs. The alternating tabs engage any one of the wall flanges 54 in an over/under cuff-like manner. The other three sides of the logic door 50 include a downwardly extending apron 56 intended to provide secure nested cover for the top edges of the walls 32, 34, 38 and 48. The logic door 50 further includes a closure mechanism 58 for securely retaining the logic door 50 in a closed condition relative to the central support frame 18. The closure mechanism includes, preferably, a lock cam 60 (FIG. 7) that is selectively engageable underneath any one of the flanges 54. The closure mechanism 50 is preferably operated by a key (not shown) thereby permitting access to the interior of the logic enclosure 16 only by those authorized to service the electronics therein. The alternating tabs 52 of the hinge feature, combined with the cam 60 and the apron 56, securely hold the logic door 50 closed over the side walls 32, 34, 38 and 48.

Figure 5:
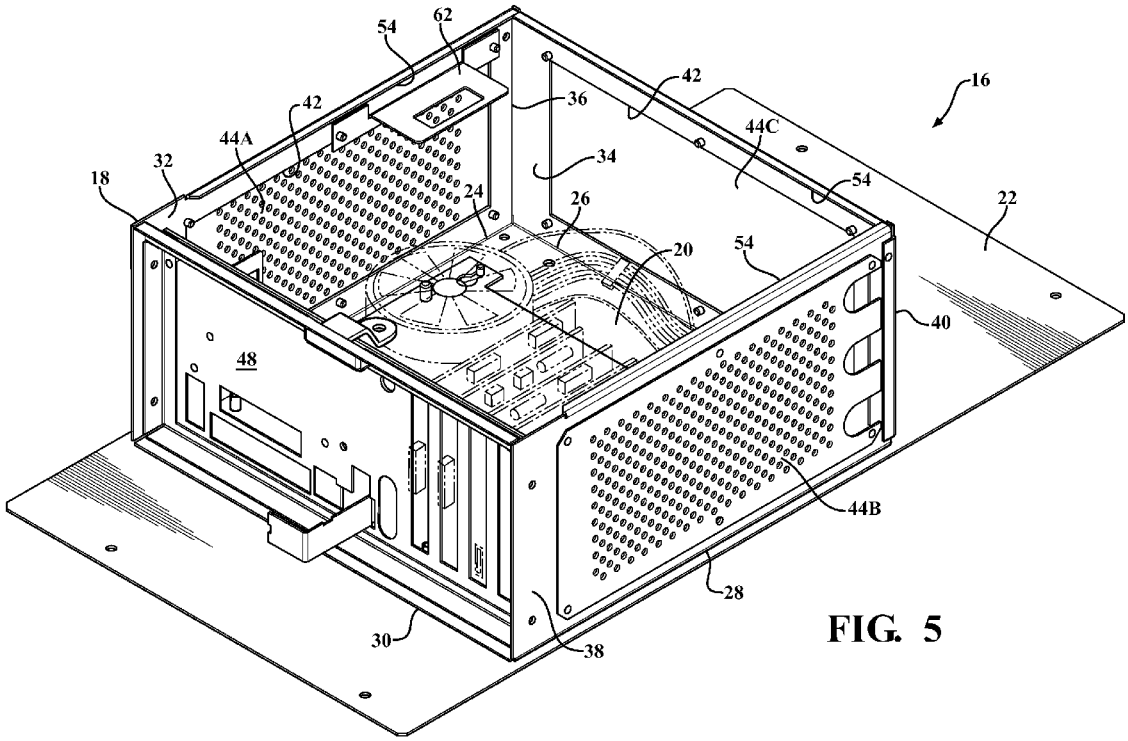
FIG. 5 is a view as in FIG. 4 showing the cover removed to reveal an interior region adapted to receive electrical components for use in executing an electronic gaming device.
Figure 6:
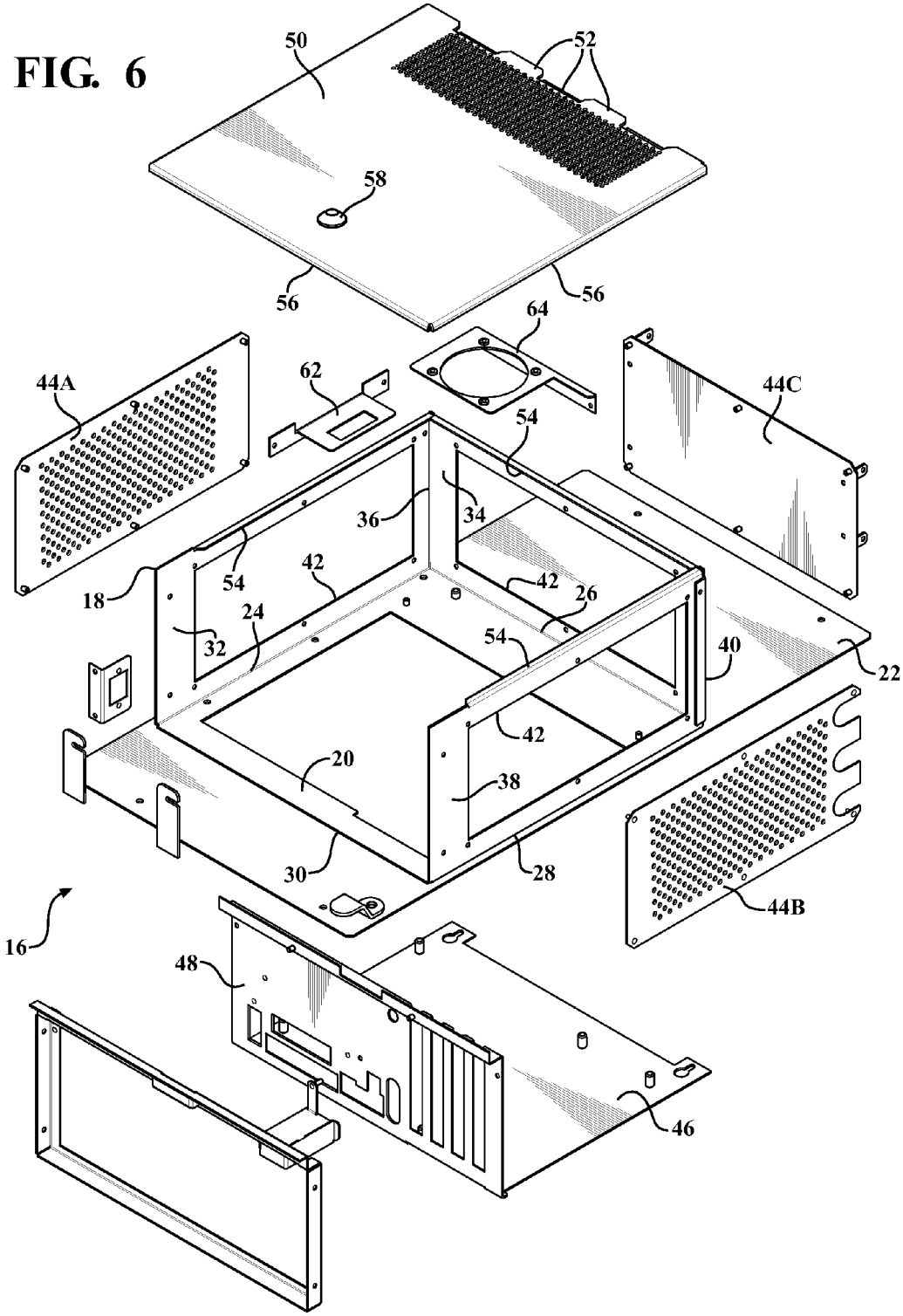
FIG. 6 is an exploded view of the logic enclosure system shown in FIG. 4.

An electrical switch (not shown) may be mounted to a switch mounting plate 62 as shown in FIGS. 5 and 6. The switch mounting plate 62 can be attached to any one of the walls 32, 34, 38, 48 with suitable fasteners. Preferably, the switch mounting plate 62 is not attached to the wall associated with either the hinge feature 52 or the closure mechanism 58. Thus, depending upon the arrangement of components within the logic enclosure 16, the switch plate 62 will be mounted to one of the side walls and support a switch that will indicate whether the logic door 50 is in an open or closed condition.

As shown in the drawings, the central support frame 18 has a generally square periphery established by the shape of the bottom 20. The first 32, second 34 and third 38 walls each respectively adjoin the bottom 20 at a generally perpendicular angle. The first wall 32 is preferably parallel to the third wall 38, whereas the second wall 34 is preferably parallel to the fourth wall 48. The resulting box-like structure enables the central support frame 18 to be reconfigured to fit the needs of diverse gaming cabinets 12 into which it may be installed. Each of the four walls 32, 34, 38, 48 includes a cutout frame or window 42 into which the interchangeable cover plates 44 are installed. The interchangeable cover plates 44 allow for the different firmware components to be oriented at the optimal orientation for any given gaming device 10 in cabinet 12 style. The cover plates 44 can be mounted in multiple orientations to permit the logic enclosure 16 to be mounted horizontally, vertically, to the back, side, bottom or even suspended from a shelf inside the cabinet 12. Several optional configurations for the cover plate 44 have penetrations to permit the wiring harnesses and cables (not shown) to be inserted therethrough. The overall dimensions of the logic enclosure 16 are such as to permit the logic door 50 to be installed in any of four directions or positions. In other words, the logic door 50 can be oriented with its hinge feature 52 gripping the flange 54 of any one of the four walls 32, 34, 38 or 48. Each of these mounting orientations also permits the door open sensor (supported on the switch plate 62) to be installed to suit the chosen orientation of the door 50.

Several of the cover plate 44 options, as well as the logic door 50, are preferably perforated to permit air flow and ventilation. These, too, can be installed on multiple sides of the enclosure 16 to ensure optimal airflow conditions. A ventilation fan mounting bracket 64 is also interchangeable, like the switch plate bracket 62, to permit the support frame 18 to be installed in several locations, again creating the opportunity to maximize air circulation for any given mounting configuration.

The fourth wall 48 is preferably designed with suitable mounting brackets and penetrations for firmware connectors and plugs. These are, generally, standard connectors and plugs which may be found in association with a standard personal computer. The fourth wall 48 can be oriented by way of reorienting the logic enclosure 16, in any side direction necessary to provide the optimal configuration within a given cabinet 12 style. The fourth wall 48 has several alternative versions to accommodate various firmware configurations.

All of the plates, panels, walls and brackets of the logic enclosure 16 are preferably designed to create an environment that cannot be accessed while the logic door 50 is closed and locked in place. This is achieved by having all of the mechanical fasteners and mounting points, such as threaded studs, point inward so that the hardware securing them can only be accessed from the inside of the central support frame 18 and then only after opening the logic door 50.

The subject logic enclosure 16 is designed to work with multiple firmware configurations, and therefore ideally suited for both original equipment and refurbished applications. A firmware configuration is typically dictated by the manufacturer of a particular operating platform. The operating platform is the system of software and firmware created to operate the functions of the particular electronic gaming device 10. Each platform provider may have a unique or even proprietary configuration, but the subject logic enclosure 16 will accommodate the majority of them. Through a series of interchangeable mounting and adaptor brackets, each firmware component can be attached to the logic enclosure 16 in a secure and convenient manner. Such mounting and adaptor brackets may be designed with standard PC components in mind.

In order to fully utilize existing cabinet components in their standard wiring configurations, the subject logic enclosure 16 is connected to existing wiring harnesses through a series of adaptors, sometimes known as "pigtails." These adaptors attach to the firmware, mounted in the logic enclosure 16, to the wiring harness of the original cabinet manufacturers installed during initial manufacturing. In some cases, these wiring harness adaptors are not necessary as the connectors and plugs, originally installed, connect to the firmware contained within the logic enclosure 16.

FIGS. 2-7 illustrate the logic enclosure 16 components and assembly in various views. The subject invention is distinguished from prior art logic enclosure devices in several ways. These include the fact that every electronic gaming device 10 contains a form of logic enclosure already. Most such prior art logic enclosures are specific only to one particular cabinet 12 model. Even within manufacturers, the logic enclosures of prior art design are not interchangeable between cabinet models. The prior art devices generally comprise a mono-shell enclosure, quick disconnect wiring features, quick disconnect metal bracketing and a wiring harness distribution port for the quick disconnect. Prior art enclosures cannot exist without this type of intricate docking system for connecting to the components of the game cabinet 12.

In contrast, one of the key features of the subject logic enclosure 16 is that it is modular in both fabrication and installation. Prior art devices are typically made of single sheets of metal, folded and welded into specific, permanent shapes. Once fabricated, prior art systems cannot be easily rearranged for use in a different cabinet 12 or configuration. If one chooses to change the hardware inside the enclosure of a prior art design, they will need to purchase a complete new enclosure as the solid design limits alternatives. However, with the subject logic enclosure 16, one may move from cabinet 12 to cabinet 12, or change internal components by simply rearranging the cover plates 44 and other features such as the location of the logic door 50, switch plate bracket 62 and fan mounting bracket 64. Furthermore, important to all commercially successful logic enclosures are their quick disconnect features. Such quick disconnect features allows casino maintenance personnel to insert the enclosure into receiving plates inside a cabinet 12. The connectors on the enclosures are designed to match the correlating receiving connectors. This eliminates the need for a casino to attach each connector separately. These quick disconnect features are also tied into additional harnessing distribution ports.

The subject logic enclosure 16 does not necessarily utilize any such quick disconnect features but instead may go "point-to-point" just like a standard desktop computer. Due to their size and the method they attach to the cabinet, prior art designs are very limited to the orientation they can be installed within a cabinet 12. As such, logic components take up a great deal of internal cabinet space. This goes hand in hand with the fact that prior art logic enclosures are designed for specific cabinets 12 and, once installed in those cabinets, they cannot be removed or placed into another cabinet 12 unless it is an identical model cabinet from the same manufacturer. Thus, prior art systems are generally single use logic enclosure systems and, once installed in a cabinet 12, are permanently linked to that model/make of cabinet. By contrast, the subject logic enclosure 16 is designed to be installed in any cabinet 12, in any model, and from any manufacturer. Advantageously, the subject invention is designed to be moved several times from cabinet 12 to cabinet 12 irrespective of make or model within its life cycle, thereby gaining cost effectiveness and utility.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A universal, convertible logic enclosure for an electronic gaming device, said enclosure comprising:

a central support frame having a bottom and a periphery defined by first, second, third and fourth edges; a first wall adjoining said bottom at said first edge thereof; a second wall adjoining said bottom at said second edge thereof; said second wall portion adjoining said first wall at a first-second corner; a third wall adjoining said bottom at said third edge thereof; said third wall adjoining said second wall at a second-third corner; said first, second and third walls each having a window opening formed therein, said window opening having generally the same dimensional attributes in each of said first, second and third walls;

a cover plate removeably disposed in each of said windows in said respective first, second and third walls; at least one of said cover plates selected from the group consisting essentially of a vent plate, a vent/wire pass-through plate, and a power supply support plate;

a floor portion, said floor portion and being dimensioned so as to slide into said central support frame between said first and third walls and overlay said bottom thereof;

a fourth wall; said fourth wall being dimensioned to slide into said central support frame and against said first and third walls proximate said fourth edge of said bottom of said central support frame; and a logic door having a generally square periphery and adapted in use to be secured relative to said first, second, third and fourth walls spaced apart from said bottom of said central support frame to establish an enclosed space for housing game control electronics, said logic door including a hinge feature adapted to selectively engage any one of said first, second, third and fourth walls.

2. An enclosure as set forth in claim 1, wherein each of said first, second, third and fourth walls include an inwardly directed flange, said hinge feature of said logic door selectively engageable with any one of said flanges.

3. An enclosure as set forth in claim 1, wherein said logic door includes a closure mechanism for securely retaining said logic door in a closed condition relative to said central support frame.

4. An enclosure as set forth in claim 3, wherein said closure mechanism includes a lock cam selectively engageable with said inwardly directed flange of the one of said first, second, third and fourth wall located opposite to said hinge feature of said logic door.

5. An enclosure as set forth in claim 1, wherein said hinge feature of said logic door comprises a series of alternating tabs.

6. An enclosure as set forth in claim 1, wherein said floor portion and said fourth wall are integrally formed as a electronics mounting plate slidable as a unit into and out of said central support frame.

7. An enclosure as set forth in claim 2, wherein said floor portion adjoins said fourth wall at a generally perpendicular angle.

8. An enclosure as set forth in claim 1, wherein said central support frame has a generally square periphery.

9. An enclosure as set forth in claim 8, wherein said first, second and third walls each respectively adjoin said bottom at a generally perpendicular angle.

10. An enclosure as set forth in claim 9, wherein said first wall is disposed generally parallel to said third wall.

11. An enclosure as set forth in claim 1, further including a mounting bracket; said bottom of said central support frame being in surface-to-surface engagement with said mounting bracket.

12. An enclosure as set forth in claim 1, further including a switch mounting bracket operatively disposed between one of said first, second, third and fourth walls and said logic door.

13. A universal, convertible logic enclosure for an electronic gaming device, said enclosure comprising:

a mounting bracket;

a central support frame having a bottom in surface-to-surface engagement with said mounting bracket, said bottom having a generally square periphery defined by first, second, third and fourth edges; a first wall adjoining said bottom at said first edge thereof and upstanding generally perpendicularly from said bottom; a second wall adjoining said bottom at said second edge thereof and upstanding generally perpendicularly from said bottom; said second wall portion adjoining said first wall at a first-second corner; a third wall adjoining said bottom at said third edge thereof and upstanding generally perpendicularly from said bottom; said third wall adjoining said second wall at a second-third corner; said first wall disposed generally parallel to said third wall; said first, second and third walls each having a window opening formed therein, said window opening having generally the same dimensional attributes in each of said first, second and third walls;

a cover plate removeably disposed in each of said windows in said respective first, second and third walls, at least one of said cover plates selected from the group consisting essentially of a vent plate, a vent/wire pass-through plate, and a power supply support plate;

an electronics mounting plate having a floor portion and a generally perpendicular fourth wall; said floor portion being dimensioned so as to slide into said central support frame between said first and third walls and overlay said bottom thereof; said fourth wall being dimensioned to slide into said central support frame and against said first and third walls proximate said fourth edge of said bottom of said central support frame; and a logic door having a generally square periphery and adapted in use to be secured relative to said first, second, third and fourth side walls spaced apart from said bottom of said central support frame to establish an enclosed space for housing game control electronics, said logic door including a vent section; said logic door including a hinge feature adapted to selectively engage any one of said first, second, third and fourth walls; said hinge feature comprising a series of alternating tabs; said logic door including a closure mechanism for securely retaining said logic door in a closed condition relative to said central support frame;

a switch operatively disposed between one of said first, second, third and fourth walls and said logic door.

* * * * *